United States Patent [19]

Ito et al.

[11] 4,176,965

[45] Dec. 4, 1979

[54] METHOD AND APPARATUS FOR WEIGHING AGGREGATES

[75] Inventors: Yasuro Ito; Hideharu Kaga, both of Tokyo; Yasuhiro Yamamoto, Kawasaki; Kenji Kuroha, Tokyo; Mitsutaka Hayakawa, Kamakura, all of Japan

[73] Assignees: Yasuro Ito; Taisei Corporation, both of Tokyo, Japan

[21] Appl. No.: 858,635

[22] Filed: Dec. 8, 1977

[30] Foreign Application Priority Data

Dec. 9, 1976 [JP] Japan ..... 51-147180

[51] Int. Cl.[2] ..... B28C 7/04

[52] U.S. Cl. ..... 366/8; 73/74

[58] Field of Search ..... 73/432 R, 432 PS, 74, 73/433, 437; 177/1; 366/8, 6

[56] References Cited

U.S. PATENT DOCUMENTS

| | | | |
|---|---|---|---|
| 1,712,621 | 5/1929 | Johnson | 73/74 |
| 1,733,410 | 10/1929 | Johnson | 177/1 X |
| 2,167,156 | 7/1939 | Morrissey | 366/8 |
| 2,264,223 | 11/1941 | Stancliffe | 73/432 PS |
| 3,813,947 | 6/1974 | Hinde | 73/432 PS |
| 3,871,489 | 3/1975 | Patigalia | 177/1 |

FOREIGN PATENT DOCUMENTS

| | | | |
|---|---|---|---|
| 124703 | 3/1959 | U.S.S.R. | 73/73 |

*Primary Examiner*—S. Clement Swisher

*Attorney, Agent, or Firm*—Birch, Stewart, Kolasch and Birch

[57] ABSTRACT

The weight of aggregate for preparing concrete and mortar is measured while the aggregate is immersed in water contained in a container. The water in the container is discharged and the water in the interstice in the aggregate is also removed. Thereafter the weight of the aggregate is measured again. These measured values of the aggregate are used to determine the quantity of water to be added to the aggregate when it is used to prepare concrete or mortar.

24 Claims, 9 Drawing Figures

METHOD AND APPARATUS FOR WEIGHING AGGREGATES

BACKGROUND OF THE INVENTION

The present invention relates to a method and apparatus for weighing aggregate, and for determining the quantity of water for mixing concrete and the like, more particularly the present invention is directed to a method and apparatus for weighing the amount (weight or volume) of normal or light weight fine aggregates (sand or metallic, inorganic or organic fibers, such as synthetic fibers) or coarse aggregates (gravel, crushed stone, artificial aggregates) which are utilized in the manufacture of building stocks, civil structural members, etc., such as concrete, mortar, grout, wall structures and coating compositions which utilize such hydraulic substances as cement and plaster the present invention is also concerned with a method and apparatus for determining the quantity of water utilized to admix the hydraulic substances and the aggregates for manufacturing the products described above.

In the manufacture of such products by using the hydraulic substances, the latter are admixed with water and the aggregate (which is not used in the case of manufacturing pastes). To this end, it is necessary to weigh the aggregate and to determine the quantity of water. According to the prior art method, however, it has been extremely difficult to accurately and continuously determine the weight of the aggregate because the weight and volume thereof differ depending upon its water content. Generally, these aggregates are natural products, and even when artifical aggregates are used, they are stocked outdoors so that the quantity of water adhering or contained in the natural and artificial aggregates varies greatly depending upon such weather conditions as rain, sun shine, and atmospheric humidity. Moreover, even in the same lump of the aggregate, the quantity of water adhering to or contained in the aggregate varies continuously from the surface portion to the inside of the lump and the manner of said variation varies substantially. Assuming that the shape and composition of the natural aggregate collected in the same place are the same, the quantity of water adhering or contained in the aggregate varies for the reasons described above. Not only the weight but also the volume of the aggregate vary greatly. For example, the apparent volume is caused to vary by the amount of water. For this reason, the weight of the aggregate measured by the conventional weighing method does not show the net weight thereof. Accordingly, the amount of water determined by such erroneous weight of the aggregate is also not correct. Only when the optimum quantity of water is utilized can products having the maximum strength and the highest quality be produced. Especially, when concrete or mortar is poured into a prepacked mold under a reduced pressure condition according to an invention formally developed by us, the pouring characteristics vary delicately depending upon the quantity of water incorporated within the aggregate which greatly influences the structure and surface condition of the products.

Of course, the fact that the accurate weighing of the aggregate is difficult due to the variation in the quantity of water adhering to or contained in the aggregate has been well known in the art and various efforts have been made to overcome this difficulty. One of the improved methods is to weigh the aggregate under dry state. However, to dry the aggregate it requires a long time to heat and dry it. Such a expedient is possible for treating only a small quantity of aggregate in laboratries but not practical in factories and fields where a large quantity of the aggregate is used. Another method is known as the Inundator method in which the aggregate is weighed while being immersed in water. This method is specified in Japanese Industrial Standard (JIS) A 1109, 1110, 1111, 1134 and 1135. According to this method it is possible to weigh the aggregate in a short time by merely immersing the aggregate in water without the necessity of heating the same for a long time in order to obtain an absolutely dry state. According to this method, however, the following disadvantages appear after the measurement. The immersed aggregate contains a large quantity of water after drainage. Even in the case of a coarse aggregate, the remaining water is such that it is necessary to wipe each aggregate with cloth as prescribed by JIS. In the case of a fine aggregate such as sand, it is extremely troublesome to remove the remaining water. In addition, as the method of measuring the weight and volume of the aggregate in water utilizes the volume of the aggregate and the difference in the specific gravity of water and aggregate the presence of air in and about the aggregate results in a large error in the resulting measurement. For this reason, according to the provision of JIS, the measurement should be performed after completely removing air bubbles from the aggregate by immersing it in water for a long period of time of about 24 hours. In the field, however, immersion in water for such long time greatly delays the job. Immersion of the aggregate in water for 24 hours is too long for modern methods of preparing concrete products according to which the products completely cure and can be taken out from the mold in only several hours. Moreover, in recent years the water to cement ratio has been decreased substantially. For these reasons the Inundator method does not find practical use and accordingly it has been required to intermittently measure the water content of the aggregate. Strict control can be made only by frequent sampling and it has been impossible to accurately determine the water quantity of the entire amount of the aggregate, thus failing to assure the production of products having uniform quality due to uneven fluidity and mechanical strength.

SUMMARY OF THE INVENTION

Accordingly it is an object of the present invention to provide a method and apparatus for weighing aggregate and for rapidly determining the quantity of water to be added to the aggregate when it is used for the preparatin of concrete or mortar without being affected by weather condition and the amount of water absorbed in the aggregate. According to one aspect of this invention, there is provided a method of weighing aggregate comprising the steps of loading the aggregate in a container, pouring water into the container, weighing the aggregate while it is being immersed in the water, discharging the water out of the container, removing water remaining in the interstice of the aggregate and weighing the resulting aggregate thus dehydrated.

According to another aspect of this invention there is provided apparatus for weighing aggregate comprising a vertical container having an aggregate loading opening at the top, means for weighing the container, a filter cylinder contained in the container with a gap therebetween, said filter cylinder being provided with perforations of a size not permitting passage of the aggregate, water discharge means connected to the lower portion of the gap, said container and said filter cylinder being provided with bottom openings for discharging the aggregate, and means for removing water in the filter cylinder.

BRIEF DESCRIPTION OF THE DRAWINGS

Further objects and advantages can be more fully understood from the following detailed description taken in conjunction with the accompanying drawings in which.

DESCRIPTION OF THE PREFERRED EMBODIMENTS

Figure 1:
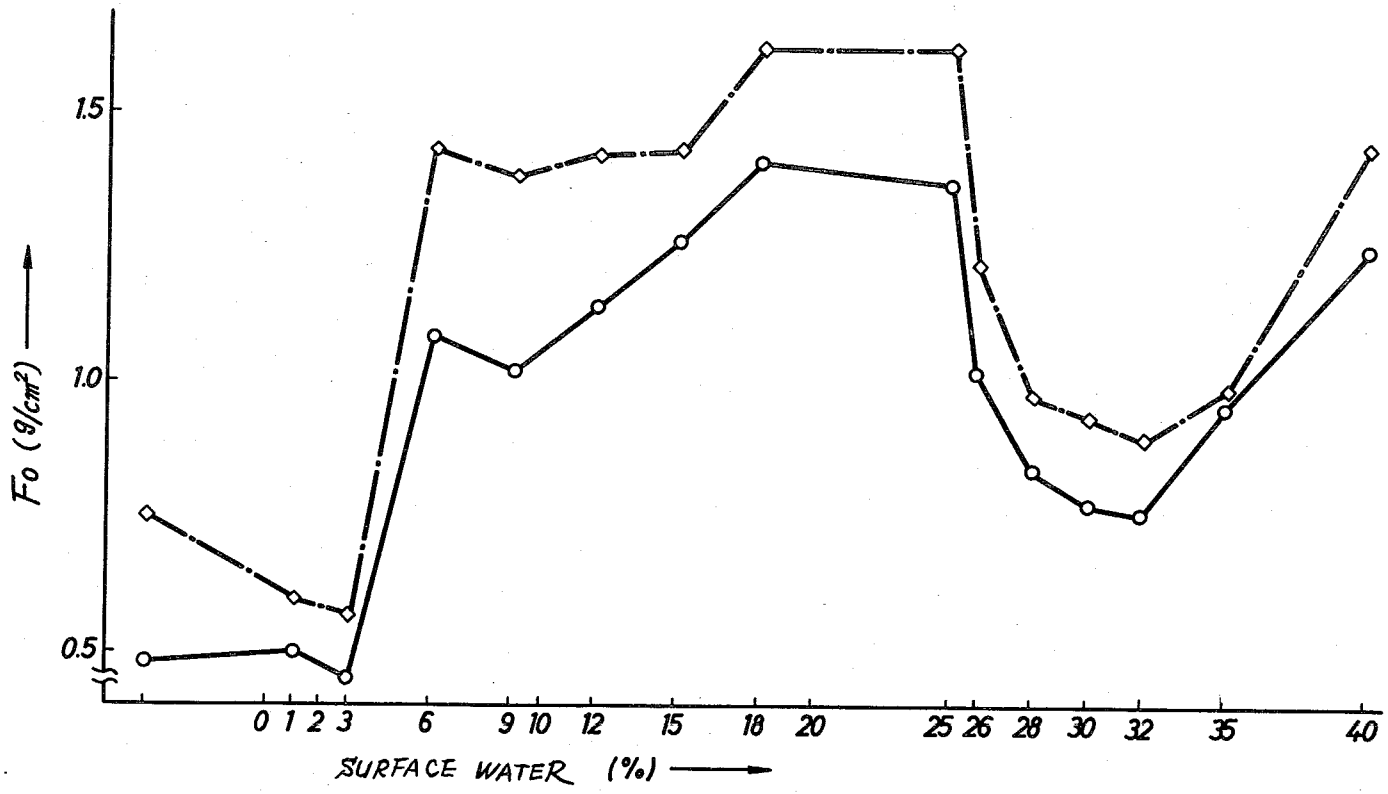
FIG. 1 is a graph showing the relationship between the fluidity of mortar and the surface water on a fine aggregate.

We have found that when the weight of fine and medium particle size sand is measured by the Inundator method or JIS (A 1109–1111, 1134 and 1135) and thereafter water in the container is drained, the sand still contains about 25 to 40%, by weight, of water, and that the water thus contained in the sand does not decrease for a substantial time. For example, the weight of fine sand having a coarseness of 1.89 and placed in a filter in a container was measured and then the water in the container was discharged through a discharge opening considerably spaced apart from the filter. Immediately after completion of the discharge of the water, the amount of the water contained in the sand was 37.5% by weight. After lapse of 5 minutes the content of the water was 37.125% by weight, and after 9 minutes the content decreased below 37% by weight. Similarly, in the case of medium particle size sand having a coarseness of 2.33, the water content immediately after discharge was 28.5%, after 5 minutes 28.25% and after 10 minutes still higher than 28%. The state of coexistence of sand and water is analogous to that of a mixture of a powder and water. As already has been reported in literature there are capillary, funicular and pendular states between slurry and dry state of the sand. Although it is relatively easy to remove water from a slurry in which particles are suspended in liquid and a capillary state mixture in which particles do not contact each other and air is not contained in the interstices therebetween, it takes a substantial time to transit from the capillary state to the first or second funicular state in which air permeates continuously or discontinuously into the interstices between the particles of fine aggregate and in which water also presents as a continuous phase or to the pendular state in which particles of the aggregate contact with each other to form a continuous phase of the particles. When preparing concrete by mixing together sand and coarse aggregate, that is gravel, the water contained in the solid particles is not advantageous in most cases. When mortar is poured into a mold prepacked with coarse aggregate under a reduced pressure condition by the prepack method previously proposed by the inventors, the water contained in the solid particles has a great influence upon the preparation of the mortar, the fluidity thereof at the time of pouring, as well as the strength and quality of the product thus failing to produce satisfctory products.

More particularly, when preparing concrete by admixing water, sand and coarse aggregate according to a conventional formulation, that is 1000 Kg of coarse aggregate, 350 Kg of cement, and 650 Kg of sand to obtain cement having water to cement ratio of 51%, the amount of necessary water is 15 Kg. Assuming that the sand contains 37.5% of water, then the quantity of water incorporated in the cement amounts to $650 \times 0.375 = 244$ Kg which is 82 Kg which is larger than the required quantity (15 Kg). Even with medium particle size sand which contains 28% of water, 10 minutes after discharge of the immersion water, it contains $650 \times 0.28 = 182$ Kg of water which is larger than the required quantity by 20 Kg. Furthermore, when preparing cement having water to cement ratio of 60% according to another commonly used formulation, that is 1000 Kg of coarse aggregate, 700 Kg of sand and 300 Kg of cement the necessary quantity of water is 162 Kg. The content of water of medium particle size sand 10 minutes after discharge of the immersion water is $700 \times 0.28 = 196$ Kg which is larger than the necessary quantity by 34 Kg. In all other cases the water content of sand is surplus. As above described when preparing concrete by admixing sand, coarse aggregate and cement, sand that contains more than 28% of water after discharge of the immersion water can not be used satisfactory. Moreover, as above described, the water contained in sand has a substantial influence upon the characteristics of the resulting concrete. For example, where river gravel having a particle size of less than 25 mm, absolutely dry specific gravity of 2.55 and dry surface specific gravity of 2.60 is used as the coarse aggregate and this coarse aggregate is mixed with river sand having a grain size of less than 5 mm, absolutely dry specific gravity of 2.57 and dry surface specific gravity of 2.62, and cement to prepare concrete 6 types of river sands respectively containing water of 2.1%, 5%, 7.5%, 10%, 15% and 20% were prepared. 31 Kg of each river sand, 13 Kg of cement, and absolutely dry river gravel were admixed to prepare samples of concrete having the same water to cement ratio (W/C) of 65%. The slump values of these samples were 15.0 cm where the river sand contains 2.1% of water, 16.3 cm for the water content of 5%, 8.5 cm for the water content of 7.5, 13.1 cm for the water content of 10%, 12.2 cm for the water content of 15%, and 9.4 cm for the water content of 20%. These data show that the characteristics of the concrete vary substantially depending upon the water content of the river sand. When preparing mortar to be utilized in the prepack method described above we have prepared various samples of sand having a water content of 4.38% and wherein the quantity of the surface water was varied variously and used these samples to prepare mortars having a sand to cement ratio (C/S) of 1:1 and water to cement ratio (W/C) of 43%. Table 1 below shows the result of test made on the fluidity, pouring characteristic, etc. of the mortars.

The pouring characteristic Fo (mm or g/cm$^3$) shown in Table 1 was obtained by using a measuring device disclosed in our Japanese patent application No. 7132/1975. This measuring device comprises a cylinder with both ends opened and packed with glass beads having a diameter of 20 cm over a length of 20 cm. The pouring characteristic was measured by measuring the head difference due to the initial shear stress yielding value of the mortar flowing through the cylinder. Symbol a ↑ in Table 1 represents the head difference between the upper surface of mortar contained in a tank and the upper surface of the mortar in the measuring device (the level of the mortar in the tank is at a higher level) when the measuring device is inserted into the mortar, whereas symbol b ↓ represents the head difference between the level of the mortar in the measuring device and the level of the mortar in the tank (in this case, the level of the mortar in the measuring device is at a higher level) when the mortar is poured through the measuring device.

With regard to the pouring characteristic, the value of Fo is high for sand having 6% to 25%, especially 18 to 25%, of the surface water but this value decreases rapidly for the sand having 26% to 35% of the surface water and increases again at 40%. Furthermore, since the mortar samples have different unit volume the quantity of bleeding water after pouring also differs as shown in Table 1.

Figure 2:
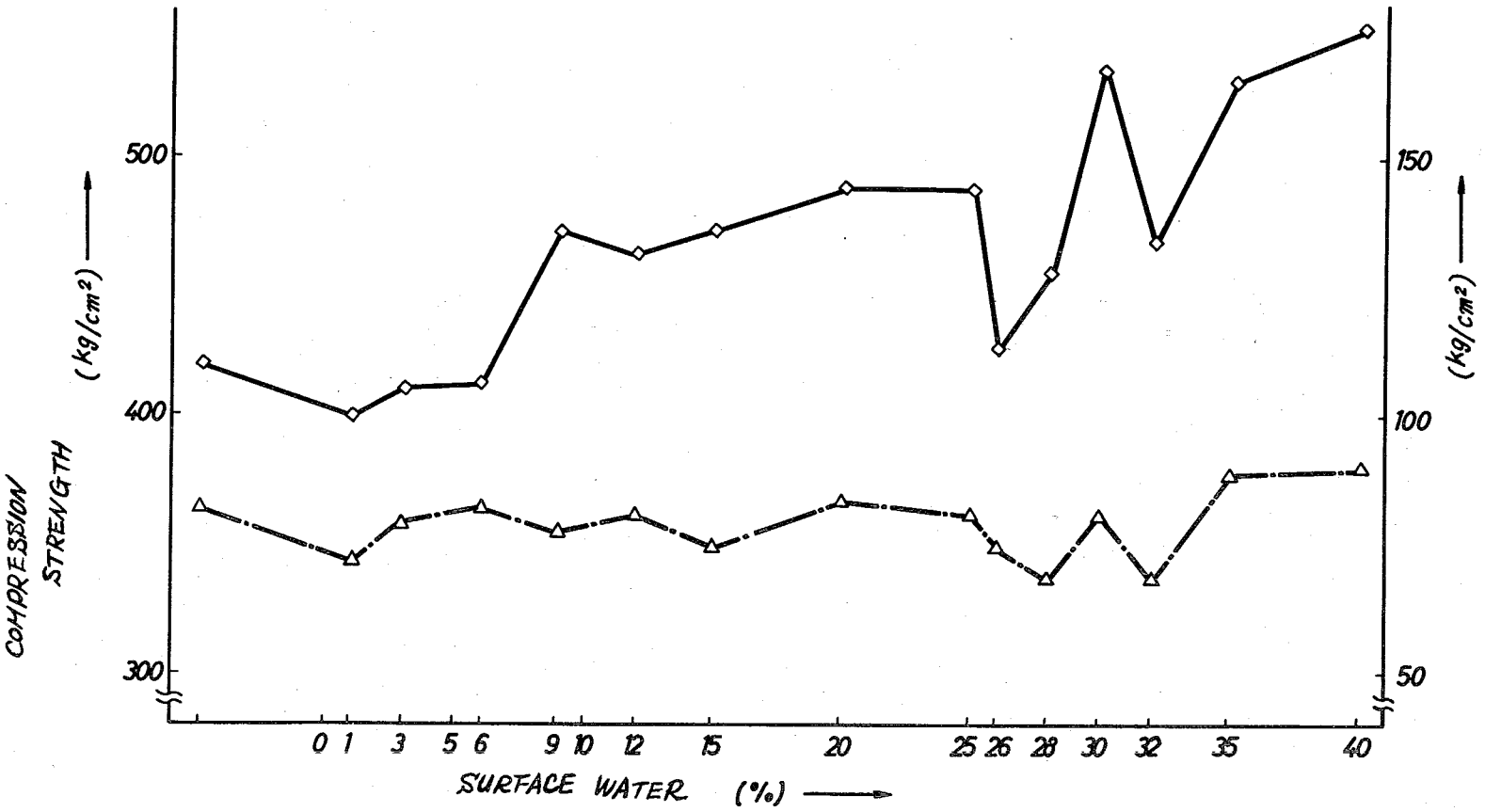
FIG. 2 is a graph showing the relationship between the compression strength of the products prepared by using the mortar described above and the surfce water on the aggregate.

The compression strength and the bending strength of the products prepared by pouring the mortar samples described above and measured 7 days after molding are shown in FIG. 2. The compression strength varies irregularly in a range of 400 to 550 Kg/cm$^3$ while the bending strength in a range of from 70 to 90 Kg/cm$^3$.

In addition to these facts we have also noted that the fluidity and the pouring characteristic vary variously when the order of incorporation of water, cement and sand is varied. In the test we used sand having a large quantity of surface water and containing 20.48% of water Ⓢ and 3.41% (S), respectively and the order of incorporation of water (W) and cement (C) to the sand was varied. There three types of incorporation, viz (1) water is added to a mixture of sand and cement, (2) sand is added to a mixture of water and cement and (3) cement is added to a mixture of sand and water. 6 samples of mortars shown in Table 2 were prepared by adding 1% of a dispersing agent to each of the mortars prepared according to the three types described above. Each sample was prepared by kneading two ingredients for three minutes and then adding the third ingredient followed by kneading for four minutes.

Table 1

| | Surface | Compensated formulation | | | | | | | | | |
|---|---|---|---|---|---|---|---|---|---|---|---|
| | water of sand | sand | water added | dispersion agent | Fo (mm, g) | | P funnel flow | Unit volume | Breezing rate % | | |
| Sample | % | Kg | l | cc | a ↑ | b ↓ | sec. | Kg/m$^3$ | 30 min. | 1 hr. | 2 hr. |
| | | | | | 122 mm | 140 mm | | | | | |
| 1 | 40 | 15.648 | 0.300 | 150 | | | 76.0 | 2.050 | 0 | 0.13 | 0.10 |
| | | | | | 125 g | 144 g | | | | | |
| | | | | | 92 | 95 | | | | | |
| 2 | 35 | " | 1.050 | " | | | 53.4 | 2.088 | 0.50 | 0.8 | 1.38 |
| | | | | | 0.96 | 0.99 | | | | | |
| | | | | | 75 | 90 | | | | | |
| 3 | 30 | " | 1.800 | " | | | 45.0 | 2.080 | 0.13 | 0.40 | 0.68 |
| | | | | | 0.78 | 0.94 | | | | | |
| | | | | | 135 | 160 | | | | | |
| 4 | 25 | " | 2.550 | " | | | 53.8 | 2.030 | 0.14 | 0.24 | 0.30 |
| | | | | | 1.37 | 1.62 | | | | | |
| | | | | | 140 | 160 | | | | | |
| 5 | 18 | " | 3.600 | " | | | 50.0 | 2.020 | 0 | 0 | 0 |
| | | | | | 1.41 | 1.62 | | | | | |
| | | | | | 123 | 140 | | | | | |
| 6 | 15 | 15.473 | 4.050 | " | | | 41.5 | 2.048 | " | " | " |
| | | | | | 1.26 | 1.43 | | | | | |
| | | | | | 113 | 140 | | | | | |
| 7 | 12 | " | 4.500 | " | | | 42.0 | 2.034 | " | " | " |
| | | | | | 1.14 | 1.42 | | | | | |
| | | | | | 100 | 135 | | | | | |
| 8 | 9 | 15.473 | 4.950 | 150 | | | 48.3 | 2.038 | 0 | 0 | 0 |
| | | | | | 1.02 | 1.38 | | | | | |
| | | | | | 107 | 142 | | | | | |
| 9 | 6 | " | 5.400 | " | | | 59.0 | 2.013 | " | " | " |
| | | | | | 1.08 | 1.43 | | | | | |
| | | | | | 45 | 57 | | | | | |
| 10 | 3 | 15.150 | 6.000 | " | | | 41.8 | 2.000 | foam | foam | |
| | | | | | 0.45 | 0.57 | | | 2 | 3 | |
| | | | | | 50 | 60 | | | | | |
| 11 | 1 | " | 6.300 | " | | | 53.8 | 1.980 | foam | foam | |
| | | | | | 0.10 | 0.60 | | | 3 | 4 | |
| | | | | | 48 | 75 | | | | | |
| 12 | dry | 14.343 | 6.957 | " | | | 90.3 | 1.988 | 0.2 | 0.5 | 0.9 |
| | | | | | 0.48 | 0.75 | | | | | |

The graph shown in FIG. 1 is plotted based on the result shown in Table 1. When judged by the prior art common sense, since the ratios C/S and W/C are equal, it would be determined that these mortars have the same characteristic. However, the fluidity (flow value obtained by using a P funnel) varies from 41.5 sec. to 90.3 sec. (four times of the former) whereas the pouring characteristic (Fo) varies from 0.45 g/cm$^3$ to 1.4 g/cm$^3$ or from 0.57 g/cm$^3$ to 1.62 g/cm$^3$ (about 3 times). As shown in FIG. 1 the manner of variation is not regular.

Table 2

| Sample | cement Kg | sand Kg | water cc | dispersion agent cc | mortar symbol |
|---|---|---|---|---|---|
| 1 | 9 | 9.31 | 3940 | 90 | SC + W |
| 2 | 9 | 10.84 | 2410 | 90 | Ⓢ C + W |
| 3 | 9 | 9.31 | 3940 | 90 | WS + C |
| 4 | 9 | 10.84 | 2410 | 90 | WⓈ + C |
| 5 | 9 | 9.31 | 3940 | 90 | WC + S |
| 6 | 9 | 10.84 | 2410 | 90 | WC + Ⓢ |

Remark:
The weight of sand is the weight including water contained therein.

The following Table 3 shows the fluidity and the pouring characteristic of the six mortar samples shown in Table 2. Table 3 shows that there are substantial difference in the flow values and that the value of Fo (measured by the method described above) varies from 12 to 174 mm (14 times of the former).

Table 3

| Sample | Symbol | Upward flow (sec.) | Downward flow (sec.) | Fo mm | Temperature °C. | weight of unit volume |
|---|---|---|---|---|---|---|
| 1 | SC + W | 19.2 | 30.0 | 12 | 12.5 | 1.903 |
| 2 | ◯C + W | 15.4 | 26.8 | 30 | 15.0 | 2.070 |
| 3 | WS + C | 26.8 | 67.4 | 174 | 14.0 | 2.055 |
| 4 | W◯ + C | 27.2 | 60.8 | 160 | 14.0 | 2.047 |
| 5 | WC + S | 20.9 | 40.1 | 127 | 13.5 | 2.061 |
| 6 | WC + Ⓢ | impossible to flow | impossible to flow | impossible to flow (more than 180 mm) | 15.0 | 2.060 |

Similar tests were made on plain mortars, not incorporated with any dispersion agent these mortars being shown in the following Table 4 and having W/C ratios of 51%, 55% and 45% (incorporated with a dispersion agent, and the result of test made on seven mortar samples is shown in the following Table 5.

Table 4

| Sample | cement Kg | sand Kg | water cc | dispersion agent | mortar symbol |
|---|---|---|---|---|---|
| 1 | 9 | 9.30 | 4580 | 0 | SC + W |
| 2 | 9 | 10.44 | 3440 | 0 | Ⓢ C + W |
| 3 | 9 | 9.30 | 4940 | 0 | WS + C |
| 4 | 9 | 10.44 | 3800 | 0 | WⓈ + C |
| 5 | 9 | 9.30 | 4940 | 0 | WC + S |
| 6 | 9 | 10.44 | 3800 | 0 | WC + Ⓢ |
| 7 | 9 | 10.44 | 3440 | 0 | Ⓢ + W |

Table 5

| Sample | Symbol | Upward flow (sec.) | Downward flow (sec.) | Fo mm | Temperature °C. | Weight of unit volume | W/C % |
|---|---|---|---|---|---|---|---|
| 1 | SC + W | 17.8 | 32.6 | 90 | 12.0 | 2.025 | 51 |
| 2 | Ⓢ C + W | 31.4 | impossible to flow | 180 | 13.5 | 1.979 | 51 |
| 3 | WS + C | 21.6 | " | 150 | 12.0 | 1.997 | 55 |
| 4 | WⓈ + C | 27.0 | " | 190 | 12.5 | 1.997 | 55 |
| 5 | WC + S | 17.6 | 31.7 | 145 | 12.5 | 1.978 | 55 |
| 6 | WC + Ⓢ | 20.0 | impossible to flow | 160 | 13.0 | 1.980 | 55 |
| 7 | Ⓢ C + W | 22.0 | " | 190 | 17.0 | 1.952 | 51 |

These Tables show that mortar samples, even having the same formulations have considerably different fluidity (flow value Fo). From Tables 3 and 5 it can be noted that mortars using sand Ⓢ containing a large quantity of water shows lower fluidity and pouring characteristic than the mortars using sand S containing a small quantity of water. Especially, mortar SC+W prepared by first admixing sand having low water content and cement and then incorporating water to the mixture shows excellent fluidity and even when water and sand are admixed firstly and then cement is added to the mixture, the pouring characteristic and the fluidity are governed by the quantity water contained in the sand.

Figure 3:
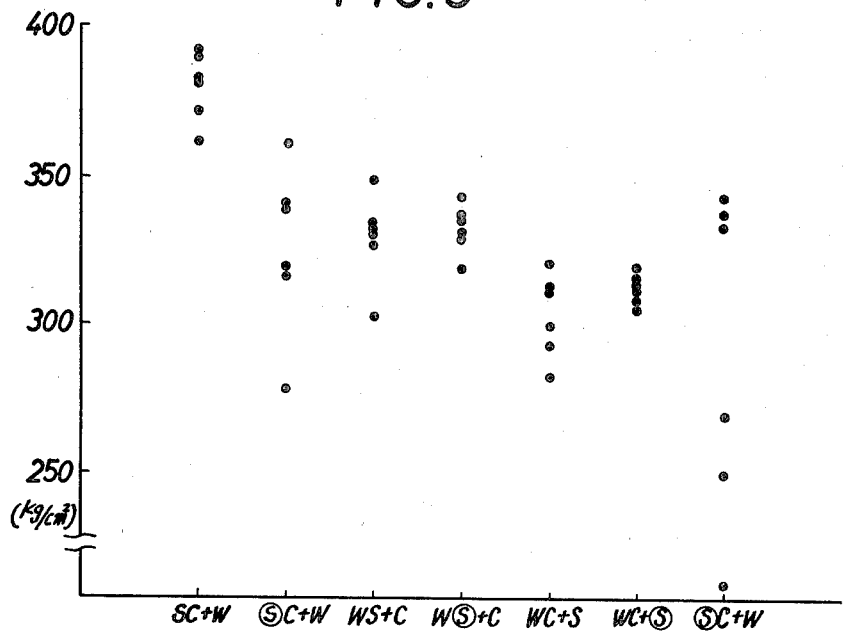
FIGS. 3 and 4 are graphs showing the strength of various mortars prepared by varying the order of compounding the same and the content of water of the sand utilized to prepare the mortars.
Figure 4:
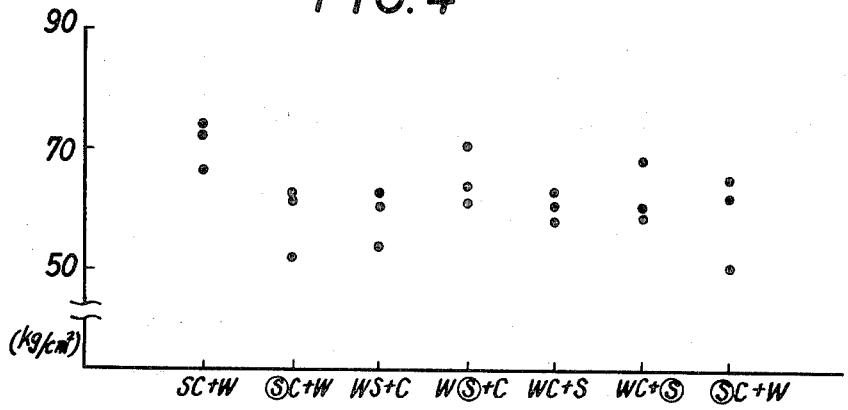

Mortars prepared in a manner described above were molded and the strength of the product one week after molding was tested and shown in FIGS. 3 and 4. As shown, mortar SC+W shows excellent compression strength and bending strength. Moreover, these characteristics vary in a narrow range thereby producing products of stable quality.

From the foregoing description, it can be noted that when aggregate is weighed in water it is possible to ignore the variation in the quantity of water adhering to the aggregate. However, even when the products are prepared by using such aggregate it is necessary to remove the water contained between said aggregate to an extent not causing trouble in actual jobs.

We have now devised apparatus shown in FIGS. 5–9 capable of weighing aggregate after removing water contained in the interstices. According to this invention, the weight of the aggregate is weighed while it is being immersed in water just in the Inundator method. Thus, it is possible to use either one of the weight method and volume method prescribed in JIS and then the aggregate is weighed after the water contained in the interstice in the aggregate has been removed under a predetermined condition to be described later by using the apparatus shown in FIGS. 5 to 9, thereby determining the quantity of water to be added based on the weight of the aggregate thus determined.

Figure 5:
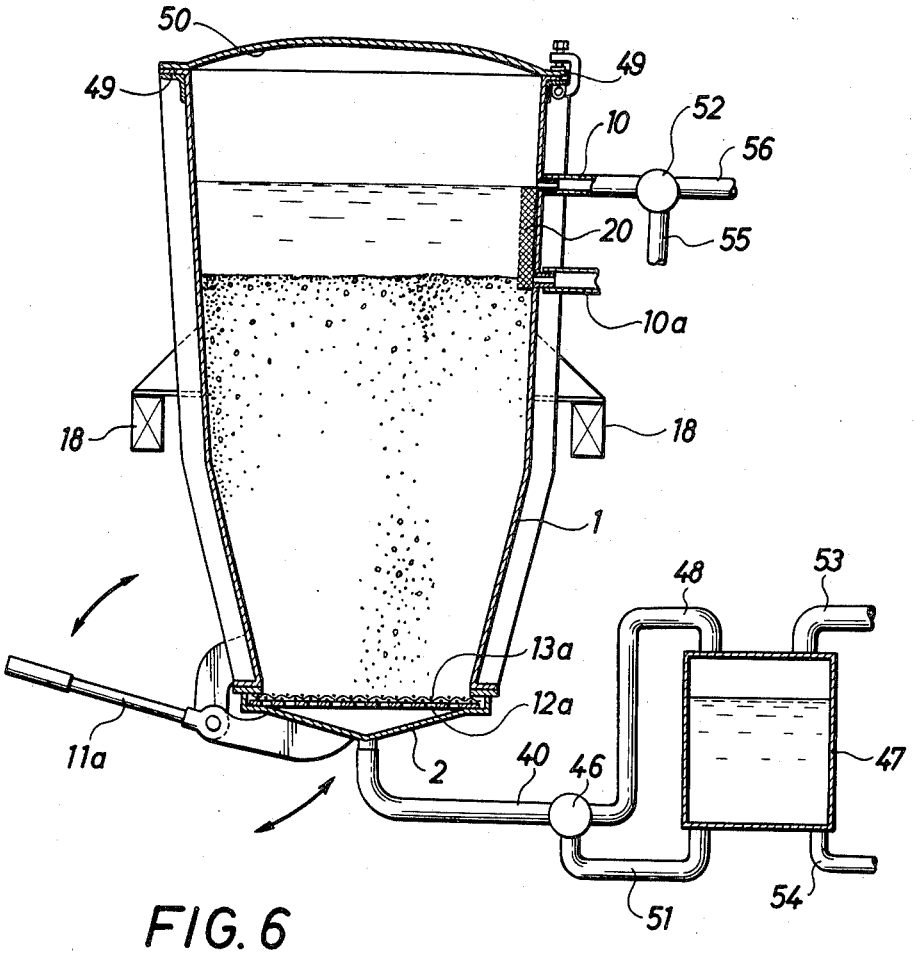
FIG. 5 is a longitudinal sectional view of one example of the weighing apparatus embodying the invention.
Figure 6:
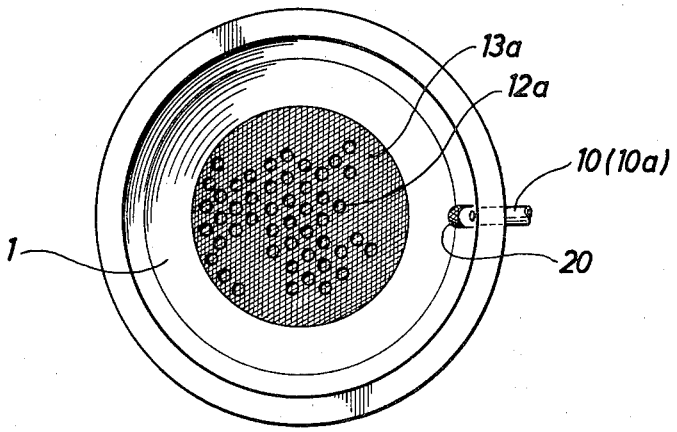
FIG. 6 is a plan view showing the inside construction of the weighing apparatus shown in FIG. 5.

The apparatus shown in FIGS. 5 and 6 comprises a hopper shaped container provided with a concave bottom cover 2 operated by a lever 11*a*. The upper opening of the cover is covered by a steel plate 12*a* formed with small perforations having a diameter of 3 to 5 mm, for example, and a metal wire net 13*a* having openings not to pass the aggregate to be weighed. A semicircular metal wire net cylinder 20 which also does not pass the aggregate is secured to one side wall of the container at locations slightly above the upper surface of the aggregate, the level of the aggregate being slightly above the center of the container. A first overflow pipe 10 opens at the upper end of the metal wire net cylinder 20 while a second overflow pipe 10*a* opens at the lower end of the cylinder 20. The second overflow pipe is normally closed, but opened after the aggregate has been loaded to discharge water above the aggregate. The first overflow pipe 10 is connected to a discharge pipe 55 and another pipe 56 through a three way valve 52. Although not shown in the drawing, the pipe 56 is connected to an evacuation device and to a pressurizing device through a transfer valve so as to evacuate or pressurize the upper portion of the container 1. A water supply and discharge pipe 40 is connected to the bottom of the cover 2, and a weighing device 18 is secured to the intermediate portion of the container. The water supply and discharge pipe 40 is connected to the top and bottom of an air-water separation tank via transfer valve 46 and pipes 48 and 51 respectively. Similar to pipe 56, a pipe 53 connected to the top of the tank is connected to an evacuation device such as a vacuum tank of a vacuum pump or an exhaust fan and to a pressurizing device through a transfer valve, not shown. The overflow pipe 10*a* is provided with a valve, not shown, and a upper cover 50 is hermetically secured to the upper end of the container 1 via a packing ring 49 thus enabling to evacuate or pressurize the interior of the container 1. The pipe 51 connected to the transfer valve 46 is connected to the bottom of tank 47 to which is also connected another water supply and discharge pipe 54 for supplying or discharging water into and out of the tank according to the level thereof. The water discharged from this tank is advantageously used for preparing concrete or mortar.

The apparatus shown in FIGS. 5 and 6 operates as follows. After loading such aggregate as sand in the container 1 the pressure therein is decreased, if desired, to remove air. At this time, the transfer valve 46 is switched to feed water into the container 1 from tank 47 or pipe 54 connected thereto until the level of the water reaches the overflow pipe 10 above the surface of the loaded aggregate. When the pressure in the upper portion of the tank is reduced, pouring of water is enhanced. The aggregate is weighed under this condition. An alkylsulfonic-acid surface activation agent of 0.5% in weight of the aggregate may be incorporated into said water. Further, it is effective to add a rubber-emulsion diluted-solution of less than 0.3% in weight of the aggregate for improving the characteristic of said aggregate. Thereafter, the valve of the second overflow pipe 10*a* is opened to discharge the water above the aggregate. Thereafter, the water in the bottom cover 2 is discharged into tank 47 via pipe 51. Then transfer valve 46 is switched to connect the evacuating device or the exhaust fan to the bottom of the container to more efficiently discharge water. If the pressure in the tank were reduced while the water is filling the space above the aggregate it would be difficult to readily remove water in the interstice between the particles of the aggregate due to the surface tension and viscosity of water. However, as above described, when a vacuum is applied after exposing the upper surface of the aggregate by discharging water through the second overflow pipe 10*a*, the water in the interstice can be readily and efficiently removed by the air passing therethrough. When discharging water as above described it is effective to pressurize the upper portion of the container 1 by operating the transfer valve 52 so as to connect the pressurizing device to pipe 56 while water is discharged through pipe 40 thereby increasing the pressure difference between the upper and bottom portions of the container 1. To evacuate or pressurize, the upper cover 50 and the overflow pipe 10*a* are closed, but when discharging water by using an exhaust fan, the upper cover 50 may be left open. Either one of the methods of discharging water is selected depending upon the operating condition. After the water has been discharged, the lower cover 2 is opened by lever 11*a* to take out the aggregate from which interstice water has been removed. To enable opening and closing of the bottom cover 2, a flexible pipe provided with a helical metal wire on its inner side is suitable for use as pipe 40. Since the water discharged from the container is contaminated it is not desirable to discharge it to a river or the like from the standpoint of public hazard so that it is advantageous to store it in the tank 47 for use in preparing concrete or mortar.

Figure 7:
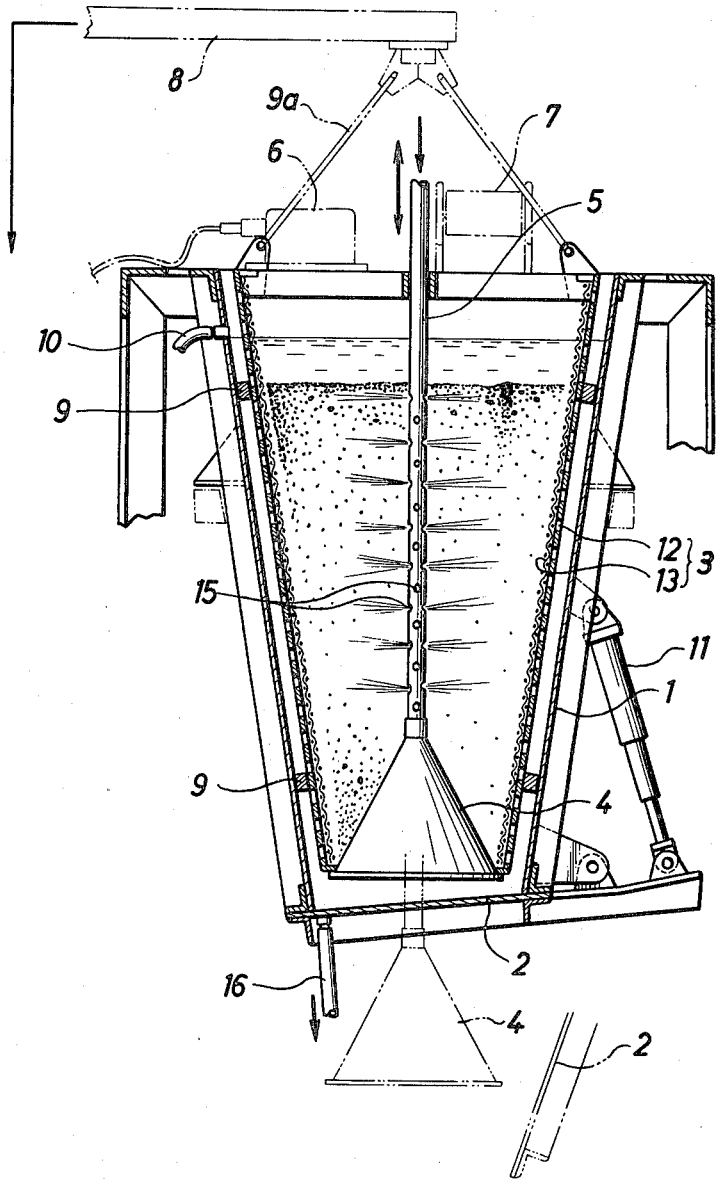
FIGS. 7, 8 and 9 are longitudinal sectional views showing other modifications of the weighing apparatus of the present invention.

FIG. 7 shows modified weighing apparatus comprising a bottom cover 2 operated by an operating cylinder 11, and a cup shaped filter cylinder 3 contained in the container 1. The filter cylinder 3 is constituted by a steel plate 2 provided with small perforations having a diameter of 3 to 5 mm, for example, and a metal wire net 13 having a mesh size not to pass the aggregate to be weighed. A suitable reinforcing member may be mounted on the outside of the filter cylinder 3 and spacers 9 are interposed between it and the inner wall of the container. A funnel shaped closure member 4 is provided to close the bottom opening of the filter cylinder 3. The closure member 4 is supported by a pipe 5 provided with a number of small perforations 15. When the pipe 5 is raised the funnel shaped closure member 4 closes the bottom opening of the filter cylinder 3 whereas when the pipe 5 is lowered, the closure member opens the bottom opening so that the content in the container can be discharged when the bottom cover 2 is opened. A vibrator 6 is secured to one side of the upper end of the filter cylinder 3 to vibrate the same, whereas a conveyor 7 is secured to the other side for loading the aggregate to be weighed into the filter cylinder 3. A weighing device 8 supports the filter cylinder 3 through hanging members 9*a* to measure the weight of the aggregate together with the weight of the filter cylinder 3 and the closure member 4. An overflow pipe 10 is connected to the upper end of the container 1 to maintain the level of the water in the container at a constant level. The water in the container 1 is discharged through a pipe 16 connected to bottom cover 2. Where the container 1 and the filter cylinder 3 have a relatively large diameter a plurality of parallel perforated pipes 5 may be provided.

Figure 8:
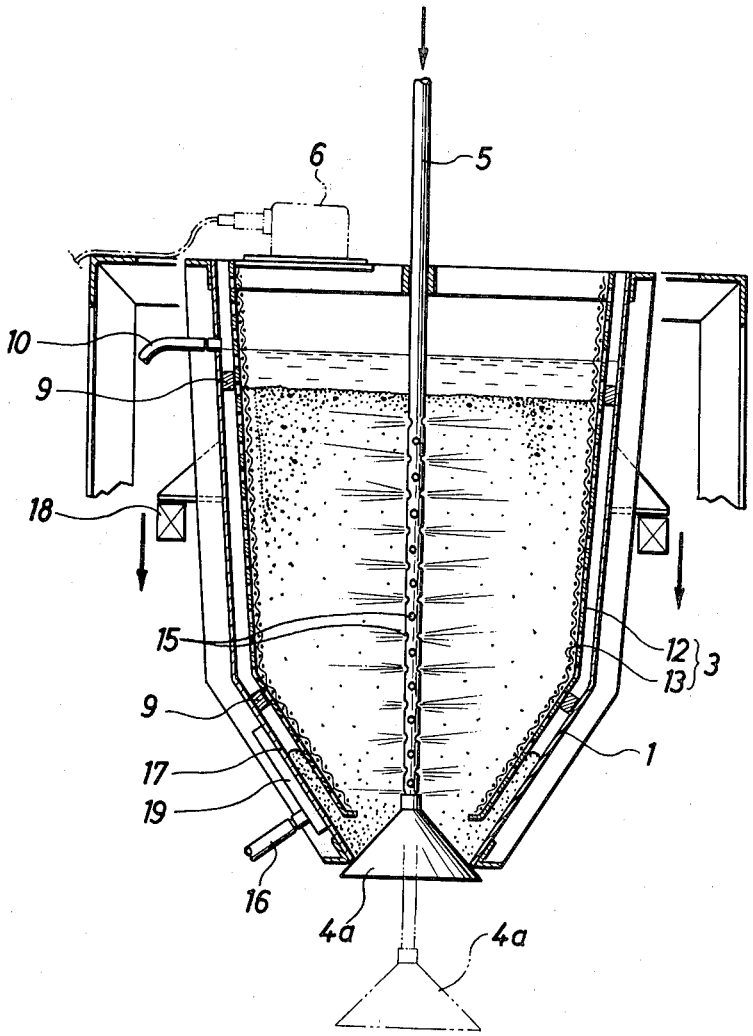

FIG. 8 shows a still further modification of the weighing apparatus in which the bottom of the container 1 is funnel shaped and a funnel shaped closure member 4*a* also acting as the bottom cover 2 shown in FIG. 7 is used to close the bottom opening of the container 1. The closure member 4*a* is raised or lowered by pipe 5 provided with a number of small perforations 15 for ejecting air. As before, spacers 9 are interposed between the filter cylinder 3 and the inner wall of the container. A water collecting chamber 19 is connected to the bottom of the container through a filter sheet 17 and a discharge pipe 16 provided with a valve, not shown, is connected to the water collecting chamber 19. Similar to the embodiment shown in FIG. 7 overflow pipe 10 is provided near the upper end of the container 1 and a vibrator 6 is connected to the upper end of the filter cylinder 3. Although in the embodiment shown in FIG. 7, the weights of the filter cylinder and its content are measured, in the embodiment shown in FIG. 8, the weights of the container 1 and all contents thereof are measured.

The method of weighing the aggregate by using the apparatus shown in FIGS. 7 and 8 is as follows. In each case, the aggregate to be weighed is loaded in filter cylinder 3 and then water is poured into the container. The weight of the aggregate while being immersed in water is then measured by the weighing device 8. Thereafter, the water in the container 1 is discharged by opening the valve of discharge pipe 16. As above described, a substantial amount of water remains in the aggregate especially in the case of sand and such residual water does not decrease after elapse of considerable time. According to the present invention, however, after the water has been discharged, the aggregate contained in the filter cylinder 3 is vibrated by the vibrator 6 and air is ejected into the aggregate through openings 15 of pipe 5 thus rapidly removing water remaining in the aggregate. The water removed in this manner is drained through pipe 16.

Figure 9:
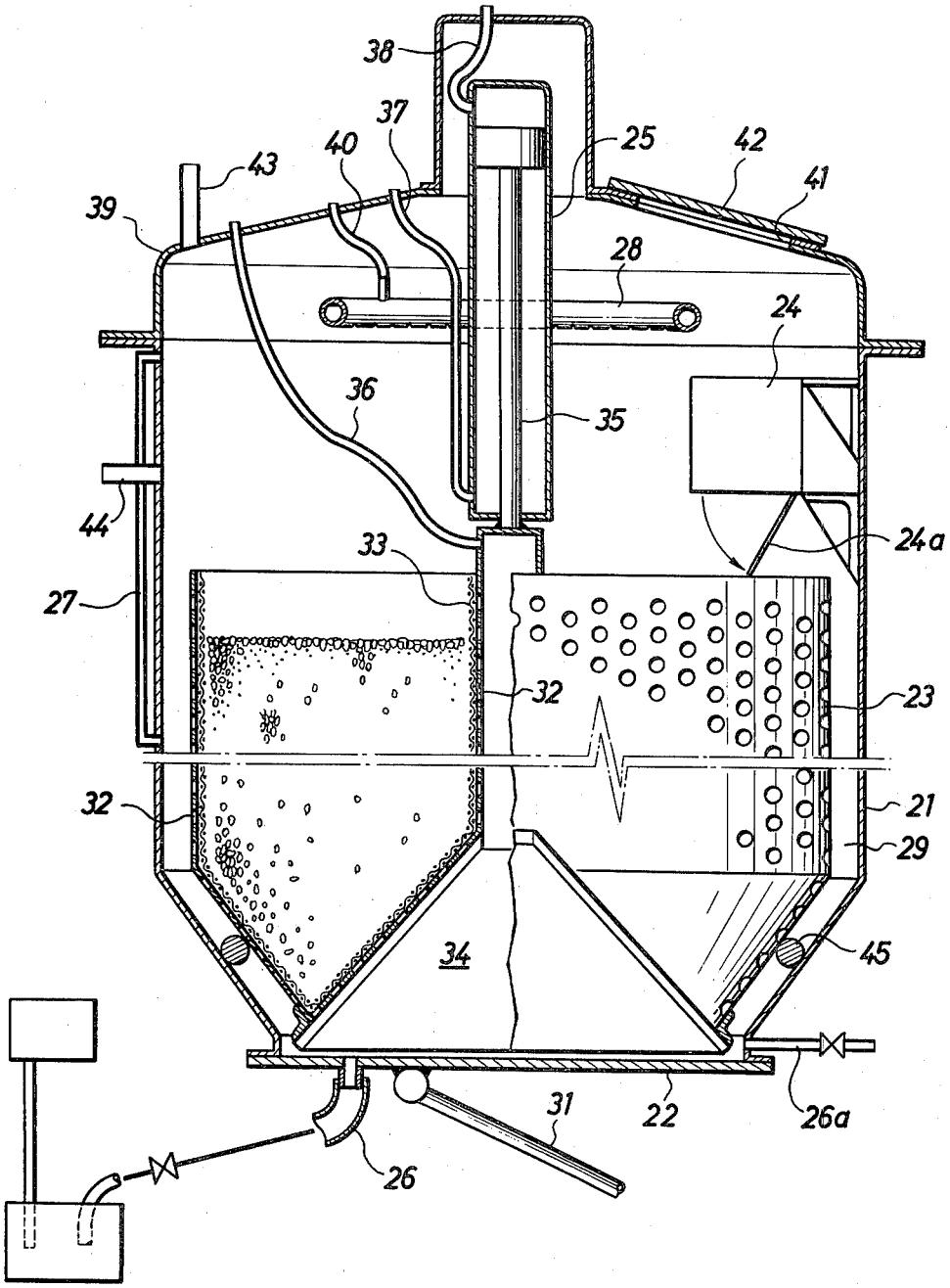

FIG. 9 shows a still further modification of the weighing apparatus suitable for light weight aggregate such as river sand or the like. The apparatus shown in FIG. 9 comprises a sealable container 42, and a filter cylinder 23 contained therein and constituted by a perforated steel plate and a metal wire net like those shown in FIGS. 7 and 8. In the embodiment shown in FIG. 9, the filter cylinder 23 further comprises a center cylinder 32 and a funnel shaped member 34 which are also covered by perforated plates and metal wire nets 33 as diagrammatically shown. The bottom of the container 21 is normally closed by a bottom cover 22 actuated by a piston rod 31 of a cylinder, not shown. Water discharge pipes 26 and 26*a* are connected to the cover 22 and to the bottom of the container 21 respectively to discharge water in the funnel shaped member 34 and in the space 29 between the filter cylinder 23 and the container 21. The center cylinder 32 and the funnel shaped member 34 are raised and lowered by an operating cylinder 25. Thus, when piston rod 35 is lowered, the bottom end of the filter cylinder 23 is opened to discharge the aggregate contained therein. The upper end of the center cylinder 32 is not covered by the perforated plate and the metal wire net and an exhaust pipe 36 extending through a upper cover 39 is connected to this exposed upper end. The opposite ends of the operating cylinder 25 are connected to air pipes for operating a piston in the cylinder. A hopper 24 having an openable bottom 24*a* is secured to the upper side wall of the container 21 for loading the aggregate. An annular water sprinkling pipe 28 is provided to surround the operating cylinder 25 and connected to a feed water pipe 40. Above the hopper 24 is formed an aggregate loading opening 41 normally closed by a lid 42. A water level meter 27 is mounted on one side of the container 21 to observe the level of the water which is poured into the container through a water feed pipe 44.

In the operation of the weighing apparatus shown in FIGS. 5 through 9, the surface of an ordinary aggregate is usually irregular, and in the case of a fine aggregate there is a tendency of entrapping air in the aggregate. Such entrapped air causes a large error in the result of measurement. For this reason, as above described, it is prescribed that the weighing should be carried out after the aggregate has been immersed in water for 24 hours. Since the aggregate is porous and irregular the error appears remarkably. Where air bubbles in such typical aggregate as fine sand, medium particle size sand, artificial light weight coarse and fine aggregates and slug are removed while the aggregate is being immersed in water, the weight in water Sw and that in dry state W and the apparent specific gravity Cw were measured and shown in the following Table 6, the weight Ws of the aggregate when it contains water being 3000 g.

Table 6

| | dry weight W (g) | weight in water S (g) | apparent specific gravity Cw | water absorption rate |
|---|---|---|---|---|
| fine sand | 2795 | 1733 | 2.481 | 0.0231 |
| medium size sand | 2820 | 1733 | 2.468 | 0.0195 |
| artificial light weight fine aggregate | 2360 | 1293 | 1.582 | 0.18 |
| artificial light weight coarse aggregate | 2615 | 911 | 1.463 | 0.0317 |
| coarse aggregate (slug) | 2843 | 1729 | 2.196 | 0.0625 |

With the apparatus shown in FIGS. 6-9, the same aggregates as above described were evacuated to a pressure of −55 cm Hg. After pouring water in the container, the pressure in the container was increased to atmospheric pressure. Thereafter, the weight Sv of the aggregate in water and the apparent specific gravity Cv were measured. The apparent specific gravity $C_{24}$ of the aggregate after immersion in water for 24 hours was also measured. The following Table 7 shows the result.

Table 7

| | weight in water after evacuation Sv (g) | apparent specific gravity Cv | specific gravity after immersion in water for 24 hr. $C_{24}$ |
|---|---|---|---|
| fine sand | 1743 | 2.501 | 2.551 |
| medium size sand | 1769 | 2.499 | 2.530 |
| artificial light weight fine aggregate | 1314 | 1.605 | 1.649 |
| artificial light weight coarse aggregate | 922 | 1.472 | 1.561 |
| | 1780 | 2.286 | 2.158 |

As the comparison of Tables 6 and 7 clearly shows the apparent specific gravity Cv and the specific gravity $C_{24}$ after immersion in water for 24 hours measured by the apparatus of this invention are larger than the apparent specific gravity Cw. The result of repeated tests shows that the error of the measurement of this invention is less than 0.02% which is smaller than the case shown in Table 6. Although the errors of the measurement after immersion in water for 24 hours and of the measurement of this invention are small, immersion in water for 24 hours is not suitable for field jobs. In contrast, according to this invention, the measurement can be made in an extremely short time.

The reason that the apparent specific gravity Cv of coarse aggregate consisting of slug is slightly lower than that obtained by this invention is that the quality of the coarse aggregates varies greatly even when they are prepared from the same slug.

Admission of air into the container under a reduced pressure condition requires only an extremely short time thus eliminating immersion time of 24 hours as prescribed by JIS. Accordingly, it is possible to accurately measure the weight of the aggregate in less than one minute which is desirable in field jobs. As will be described hereinafter, according to this invention it is advantageous to discharge water under a reduced pressure condition after measuring the weight in water. The result of such measurement can be advantageously used in prepack method in which concrete or mortar is poured under a reduced pressure for producing high quality products. When the value of vacuum utilized in various steps is made equal, the error can be reduced to a minimum. Especially, the apparatus shown in FIG. 9 is suitable for light weight aggregate. More particularly, the light weight aggregate often has a bulk specific gravity of less than unity. Such aggregate floats on the water poured into the container so that it is impossible to measure the weight of the aggregate while being immersed in water. However, the apparatus of this invention makes possible such measurement. Thus, when loading the aggregate by opening the lid major portion of the aggregate is received in the filter cylinder 23 but a portion of the aggregate is loaded in hopper 24. Thereafter, the lid 42 is sealed to the container 21 and the interior thereof is evacuated through an evacuation pipe 43 connected to the upper cover 39. Then, the air contained in the aggregate is removed. Thereafter, water is sprinkled onto the aggregate through water sprinkling pipe 28 to coat the surface of the aggregate with water. At the same time, the aggregate in the hopper 24 is also sprinkled with water. After the sprinkling, the pressure in the container is increased to the atmospheric pressure, thereby causing surface water to permeate into the structure of the aggregate. By repeating several times above described steps the light weight aggregate absorbs sufficient quantity of water so that they would not float on water. Then water is poured into the container until it comes to cover the upper surface of the aggregate, and the weight of the aggregate which is now immersed in water is measured by a suitable weighing device 45, for example a strain gage interposed between the filter cylinder 23 and container 21.

After measuring the weight in water, the aggregate in hopper 24 is gradually transferred into the filter cylinder 23 until the weight of the aggregate in the filter reaches a predetermined value. Thereafter, valves of discharge pipes 26 and 26*a* are opened and suction is applied through evacuation pipe 36 to remove interstice water. Alternatively, vibration, centrifugal force or supersonic wave may be applied. After several tens seconds the interstice water is removed and then the wet aggregate is weighed or the quantity of water to be added to the wet aggregate is determined. Since the purpose of the evacuation pipe 36 is to cause air flow, it is also possible to pass air in the opposite direction by using a fan.

The results of tests made for the removal of the interstice water after weighing in water are shown in the following Tables 8 and 9. Table 8 shows the variation with time in the remaining water in fine sand having a coarseness of 18.9 and (a) subjected to vacuum, (b) to vibration and (c) subjected to both, whereas Table 9 shows similar result when medium particle size sand having a coarseness of 23.3 was subjected to the same treatments.

Table 8

| | air flow treatment | | | | vibration treatment 0 | | air flow and vibration treatments | | | |
|---|---|---|---|---|---|---|---|---|---|---|
| Time Time | −60 cm Hg residual water (%) | | −30 cm Hg residual water (%) | | residual water(%) | | −60 cm Hg residual water (%) | | −30 cm Hg residual water (%) | |
| 0 | 32.5 | 100 | 31.5 | 100 | 31.3 | 100 | 29.0 | 100 | 33.3 | 100 |
| 10 | 21.3 | 65.6 | 21.5 | 68.2 | | | 21.5 | 74.2 | 21.3 | 63.9 |
| 20 | 17.8 | 54.8 | 19.3 | 61.2 | | | 19.8 | 68.3 | 19.5 | 58.5 |
| 30 | 16.5 | 50.8 | 18.0 | 57.1 | 25.5 | 81.3 | 18.8 | 64.9 | 18.5 | 55.5 |
| 40 | 15.5 | 47.7 | 17.3 | 54.8 | | | 18.4 | 63.5 | 17.8 | 53.1 |
| 50 | 15.0 | 46.2 | 16.5 | 52.3 | | | 17.9 | 61.8 | 17.3 | 51.9 |
| 60 | 14.3 | 44.0 | 16.3 | 51.7 | 24.0 | 76.6 | 17.6 | 60.7 | 16.8 | 50.4 |
| 70 | 14.0 | 43.1 | 16.0 | 50.7 | | | 17.4 | 60.0 | 16.5 | 49.5 |
| 80 | 13.5 | 41.6 | 15.8 | 50.1 | | | 17.1 | 59.0 | 16.3 | 48.9 |
| 90 | 13.3 | 41.0 | 15.5 | 49.1 | 23.0 | 73.4 | 16.8 | 58.0 | 16.0 | 48.0 |
| 100 | 13.0 | 40.0 | 15.3 | 48.5 | | | 16.6 | 57.3 | 15.9 | 47.7 |
| 116 | 12.8 | 39.4 | 15.0 | 47.6 | | | 16.5 | 56.9 | 15.8 | 47.4 |
| 120 | 12.6 | 38.8 | 14.8 | 46.9 | 21.9 | 69.9 | 16.5 | 56.9 | 15.6 | 46.8 |
| 130 | 12.5 | | 14.6 | | | | 16.5 | | 15.5 | |
| 140 | 12.4 | | 14.5 | | | | 16.4 | | 15.4 | |
| 150 | 12.1 | 37.3 | 14.4 | 45.6 | 20.8 | 66.4 | 16.3 | 56.2 | 15.4 | 46.2 |
| 160 | 12.0 | | 14.0 | | | | 16.1 | | 15.3 | |
| 170 | 11.9 | | 13.9 | | | | 16.1 | | 15.1 | |
| 180 | 11.8 | 36.3 | 13.8 | 43.7 | 20.0 | 63.8 | | 55.5 | 15.1 | 45.3 |
| 210 | 11.5 | 35.4 | 13.5 | 42.8 | 19.5 | 62.2 | | | | |
| 240 | 11.4 | 35.1 | 13.4 | 42.5 | 19.3 | 61.6 | | | | |
| 270 | | | | | 19.1 | 60.9 | | | | |
| 300 | | | | | 19.1 | 60.9 | | | | |

Table 9

| | treatment | | | | vibration treatment | | air flow and vibration treatments | | | |
|---|---|---|---|---|---|---|---|---|---|---|
| | - 60 cm Hg | | - 30 cm Hg | | 0 | | - 60 cm Hg | | 30 cm - 30 | |
| Time (sec) | residual water (%) | | | | residual water (%) | | residual water (%) | | | |
| 0 | 31.8 | 100 | 26.5 | 100 | 29.0 | 100 | 23.0 | 100 | 26.8 | 100 |

Table 9-continued

| Time (sec) | treatment - 60 cm Hg residual water (%) | | treatment - 30 cm Hg residual water (%) | | vibration treatment 0 residual water (%) | | air flow and vibration treatments - 60 cm Hg residual water (%) | | air flow and vibration treatments 30 cm - 30 residual water (%) | |
|---|---|---|---|---|---|---|---|---|---|---|
| 10 | 19.3 | 60.6 | 20.3 | 76.5 | | | 19.0 | 82.7 | 20.3 | 75.7 |
| 20 | 16.5 | 51.8 | 18.5 | 69.7 | | | 18.0 | 78.3 | 18.3 | 68.3 |
| 30 | 15.3 | 48.0 | 17.5 | 66.0 | 23.4 | 79.1 | 17.5 | 76.1 | 17.6 | 65.6 |
| 40 | 14.5 | 45.5 | 16.8 | 63.3 | | | 17.0 | 74.0 | 16.8 | 62.7 |
| 50 | 13.8 | 43.3 | 16.1 | 60.3 | | | 16.8 | 73.1 | 16.3 | 60.8 |
| 60 | 13.3 | 41.8 | 15.8 | 59.6 | 22.1 | 74.7 | 16.5 | 71.8 | 15.9 | 59.3 |
| 70 | 12.8 | 40.2 | 15.4 | 58.1 | | | 16.4 | 71.3 | 15.5 | 57.8 |
| 80 | 12.6 | 39.6 | 15.1 | 56.9 | | | 16.1 | 70.0 | 15.0 | 56.0 |
| 90 | 12.3 | 38.6 | 15.0 | 56.6 | 21.5 | 72.7 | 16.0 | 69.6 | 14.9 | 55.6 |
| 100 | 12.1 | 38.0 | 14.8 | 55.8 | | | 15.9 | 69.2 | 14.6 | 54.5 |
| 110 | 11.9 | 37.4 | 14.5 | 54.7 | | | 15.8 | 68.7 | 14.3 | 53.3 |
| 120 | 11.8 | 37.1 | 14.4 | 54.3 | 21.1 | 71.7 | 15.6 | 67.9 | 14.1 | 53.7 |
| 130 | 11.5 | | 14.3 | | | | 15.5 | | 14.1 | |
| 140 | 11.4 | | 14.1 | | | | 15.4 | | 14.0 | |
| 150 | 11.4 | 35.8 | 14.0 | 52.8 | 20.8 | 70.3 | 15.4 | 67.0 | 14.0 | 52.2 |
| 160 | 11.3 | | 13.9 | | | | 15.4 | | | |
| 170 | 11.3 | | 13.6 | | | | | | | |
| 180 | 11.1 | 34.9 | 13.6 | 51.3 | 20.4 | 69.0 | | | | |
| 210 | 11.0 | 34.5 | 13.4 | 50.5 | 20.1 | 67.9 | | | | |
| 240 | 10.6 | 33.3 | 13.0 | 49.0 | 20.0 | 67.6 | | | | |
| 270 | | | | | 19.9 | 67.3 | | | | |
| 300 | | | | | 19.6 | 66.2 | | | | |

Tables 8 and 9 show that residual water of more than 30% is reduced to less than 20% in less than 3 minutes. Both of the evacuation treatment and the vibration treatment are efficient in that the residual water can be reduced to about 20% in about 10 seconds. Although it may be expected that where both of the evacuation and vibration treatments are used, water removal would be efficient, actually however, the result is inferior than a case where only evacuation is used. It is presumed that this is caused by the fact that the vibration causes the aggregate particles to float upwardly thereby degrading the dehydration effect caused by reduced pressure. Even with a low degree of vacuum, dehydration is possible in a short time. More particularly, pressures of −30 cm Hg, and −60 cm Hg cause difference of only 2 to 2.5% in the residual water after treatment for 3 minutes.

Table 10 below shows the result of treatment of the fine sand as that shown in Tables 8 and 9 under a vacuum of −60 cm Hg and having different quantities loaded in the container and the result of treating 2 Kg of the same fine sand by a centrifugal machine rotating at a speed of 1420 rpm. At the time of evacuation treatment although the percentage of dehydration varies in accordance with the loaded quantity, the dehydration effect is remarkable. The dehydration efficiency of the centrifugal machine is higher than other expedients so that where the costs of installation and operation do not present any serious problem and where dehydration in a short time is desirable, use of the centrifugal machine is recommended.

Table 10

| n<br>s<br>m<br>t(sec) | 13.5 cm<br>400 g<br>200 cc<br>residual water % | | 20.3 cm<br>600 g<br>300 cc<br>residual water % | | 28.0 cm<br>800 g<br>400 cc<br>residual water % | | 34.7 cm<br>1000 g<br>500 cc<br>residual water % | | centrifugal separator 1420 r.p.m. D = 170 mm fine sand 2 Kg free from mud residual water % | |
|---|---|---|---|---|---|---|---|---|---|---|
| 0 | 31.0 | 100 | 30.8 | 100 | 33.1 | 100 | 32.5 | 100 | 30.0 | 100 |
| 10 | 12.5 | 40.4 | 14.5 | 47.1 | 16.9 | 51.0 | 20.0 | 61.6 | 9.76 | 32.5 |
| 20 | 11.5 | 37.1 | 13.3 | 43.2 | 13.8 | 41.7 | 16.5 | 50.8 | | |
| 30 | 10.5 | 33.9 | 12.5 | 40.6 | 12.5 | 37.8 | 14.5 | 44.7 | 7.25 | 24.1 |
| 40 | 9.8 | 31.7 | 11.8 | 38.4 | 11.3 | 34.1 | 13.5 | 41.6 | | |
| 50 | 9.3 | 30.0 | 11.5 | 37.4 | 10.6 | 32.0 | 13.0 | 40.0 | | |
| 60 | 9.0 | 29.1 | 11.2 | 36.4 | 10.4 | 31.4 | 12.5 | 38.5 | 6.78 | 22.6 |
| 70 | 8.8 | 28.4 | 10.8 | 35.1 | 10.1 | 30.5 | 12.2 | 37.6 | | |
| 80 | 8.5 | 27.5 | 10.5 | 34.1 | 9.9 | 29.9 | 11.9 | 36.7 | | |
| 90 | 8.5 | 27.5 | 10.3 | 33.5 | 9.6 | 29.0 | 11.6 | 35.7 | 6.67 | 22.2 |
| 100 | 8.3 | 26.8 | 10.2 | 33.2 | 9.4 | 28.4 | 11.3 | 34.8 | | |
| 110 | 8.3 | 26.8 | 10.0 | 32.5 | 9.2 | 27.8 | 11.1 | 34.2 | | |
| 120 | 8.0 | 25.8 | 9.8 | 31.9 | 9.0 | 27.2 | 10.9 | 33.6 | 6.61 | 22.0 |
| 130 | 8.0 | 25.8 | 9.7 | 31.5 | 8.9 | 26.9 | 10.8 | 33.3 | | |
| 140 | 8.0 | 25.8 | 9.5 | 30.9 | 8.8 | 26.6 | 10.7 | 33.0 | | |
| 150 | 8.0 | 25.8 | 9.3 | 30.2 | 8.5 | 25.7 | 10.6 | 32.6 | | |
| 160 | 7.8 | 25.2 | 9.2 | 29.9 | 8.5 | 25.7 | 10.5 | 32.3 | | |
| 170 | 7.8 | 25.2 | 9.0 | 29.3 | 8.4 | 25.4 | 10.4 | 32.0 | | |
| 180 | 7.8 | 25.2 | 8.8 | 28.6 | 8.4 | 25.4 | 10.3 | 31.7 | | |
| 210 | 7.5 | 24.2 | 8.3 | 27.0 | 8.1 | 24.5 | 9.7 | 29.9 | | |

Table 10-continued

| | | | | | | | | | |
|---|---|---|---|---|---|---|---|---|---|
| n | 13.5 cm | | 20.3 cm | | 28.0 cm | | 34.7 cm | | centrifugal separator 1420 r.p.m. D = 170 mm fine sand 2 Kg |
| s | 400 g | | 600 g | | 800 g | | 1000 g | | free from |
| m | 200 cc | | 300 cc | | 400 cc | | 500 cc | | mud |
| t(sec) | residual water % | | residual water % | | residual water % | | residual water % | | residual water % |
| 240 | 7.5 | 24.2 | 8.2 | 26.7 | 8.1 | 24.5 | 9.6 | 29.6 | |

The dehydration methods of this invention have different dehydration efficiency but any one of them or combinations thereof may be used for different cases. In some cases, since water is added, when the residual water can be reduced to below 20% the object of this invention can be accomplished.

As above described, according to this invention the water content of a given aggregate can readily be excepted by properly selecting the treating time and condition required for the dehydration treatment, thereby enabling to accurately determine the amount of water to be added to the aggregate necessary to prepare mortar or concrete. Even though the fluidity and pouring characteristic of mortar vary variously as above described, as the amount of water contained in the aggregate can be determined so that the quantity of the water to be added thereto can also be determined, and the fluidity and the pouring characteristic of the resulting mortar can also be readily determined. For this reason, it is possible to stabilize the quality of the concrete product utilizing the mortar. This also makes easy the pouring or casting operation of the mortar.

The following are some typical examples of this invention.

EXAMPLE 1

Fine sand collected from river Tone, Chiba Prefecture had a coarseness of 1.89, an absolute dry specific gravity of 2.60, a dry surface specific gravity of 2.66 and a percentage of water absorption of 2.31% by weight. This fine sand having an arbitorary water content was loaded in the filter cylinder 3 in the hopper shaped container 1 shown in FIG. 7 by means of belt conveyor 7. Then, while vibrating the container 1 and the filter cylinder 3 by vibrator 6 water was poured into the container 1 until the water overflows through overflow pipe 10. When the surface of the sand is completely covered by water, the water is also ejected through perforations 15 of the supporting pipe 4. When air bubbles are not generated on the surface of the water in the container 1, the inner container 3 is separated from the outer container 1 by the weighing device 8 to measure the weight of the aggregate while being immersed in water and the fine aggregate is supplemented until the weight in water of the aggregate reaches 127.5 Kg. The absolutely dry weight of the fine aggregate can be calculated by the following equation based on its dry surface specific gravity and the percentage of water absorption.

$$\text{Absolute dry weight of sand} = \text{weight in water of sand} \times \frac{\rho}{\rho - 1} \times \frac{1}{1 + \text{percentage of absorption}}$$

where p represents the dry surface specific gravity.

After weighing, the water is discharged through discharge pipe 16. At this time, the vibrator 6 is operated again to remove the interstice water and it was found that the quantity of water discharging through pipe 16 had decreased greatly by the operation of the vibrator for 2.5 minutes. At this time, the weight of the aggregate was measured again by the weighing device 8 and the measured value was 241 Kg. This value does not includes the weight of the container 1 and the filter cylinder 3. By using this value and the absolutely dry specific weight it was determined that the water content of the sand measured by the second measurement was 20.5%.

The sand weighed twice was used to prepare mortar having C:S ratio of 1:1 and a ratio W/C of 38% and incorporated with 1% of a fluidity improving additive and 39.6 Kg of additional water. The resulting mortar had a good fluidity (Fo=1.5 g) and suitable for pouring into an evacuated mold.

The weight of sand having an absolutely dry weight of 200 Kg was measured by the same method as above described without subjecting it to the dehydration treatment and found to be 262.6 Kg. This sand and 18 Kg of additional water were used to prepare mortar having the same characteristics just described. This mortar had a value of Fo of 4 g showing poor pouring characteristic.

EXAMPLE 2

In the same manner as in Example 1, at the time of discharging water through pipe 16, the vibrator 6 was operated while at the same time air in the container was exhausted through openings 15 of pipe 5 under a vacuum of −600 mm Hg for removing interstice water. After continuing this treatment for 1.5 minutes, the aggregate was weighed and found to be 232.6 Kg. Thus, the water content of the aggregate was 16.3%. To prepare the same mortar as in Example 1, 48 Kg of water was incorporated. The resulting mortar had a fluidity of Fo=1.1 g.

In contrast, the water content of sand not subjected to vibration was 26.5%. Mortar using this sand and having the same formulation as that of Example 1 had Fo=4.1 g showing the same poor pouring characteristic as the control example of Example 1.

EXAMPLE 3

Medium particle size sand collected from river Tone and having a coarseness of 2.33 was caused to absorve a sufficient quantity of water and then loaded in the filter cylinder 3 shown in FIG. 8. Before reaching a predetermined quantity, the loading of the sand was interrupted and the water was supplied into the container through perforations 15 until the generation of air bubbles at the surface of the water contained in the container ceases. During this step, the level of the water was maintained at a constant level (corresponding to 150 l) by the overflow pipe 10. Under these conditions, the weight of the sand and water in the container was measured and found to be 275.9 Kg. Then, the water was discharged through pipe 16 and at the same time the interstice water was removed by operating the vibrator 6 and evacuating the interior of the container 1 through perforations 15 under a vacuum of −30 cm Hg. After continuing the dehydration treatment for 1.5 minutes the weight was measured again and found to be 230.8 Kg, and the water content at that time was 15.4%. This sand, 32.3 Kg of additional water and 1% of the fluidity improving additive were used to prepare mortar having a C/S ratio of 1:1 and W/C ratio of 34%. The resulting mortar had an excellent pooring property of Fo=1.8 g.

As a control, after discharging the water through pipe 16, the same sand as above described was caused to dehydrate naturally for 5 minutes and then the weight of the sand was measured and found to be 266.6 Kg and its water content was 33.3%. To prepare mortar having the same formulation as above described by using this sand, the quantity of water to be added was determined to be −4.1 Kg. In other words, it was impossible to prepare mortar having a desired value of W/C ratio.

EXAMPLE 4

A sufficient quantity of the same sand as in Example 1 was loaded in the filter cylinder 23 of the apparatus shown in FIG. 9 and then the pressure in the container 21 was reduced to −60 cm Hg. Thereafter water was poured into the container. No bubble was generated until the water in the container overflows. Thereafter, the pressure in the container was increased to atmospheric pressure and the weight of the sand was measured and was found to be 127.8 Kg. Thereafter, the water was discharged through the discharge pipe and the evacuation pipe 36 was connected to an evacuation device to decrease the pressure in the central cylinder 32 to −60 cm Hg thus inducing a flow of air through the aggregate layer to remove the interstice water between the aggregate particles. After this evacuation treatment which was continued for 30 seconds the weight of the aggregate and the filter cylinder was measured and found to be 233 Kg and the water content of the sand was 16.5%. This sand was used to prepare mortar together with 45.6 Kg of additional water and 1% of the fluidity improving additive. The mortar had a C/S ratio of 1:1, a W/C ratio of 37% and a fluidity of 2.2 g and suitable for the prepack method described above. On the other hand, the water content of the aggregate which was not subjected to the dehydration treatment described above following the measurement of the weight in water but drained naturally was 29%. Mortar having the same formulation as above described was prepared by using this sand. The value of Fo of this mortar was 3.5 g showing an extremely poor pouring characteristic.

EXAMPLE 5

When weighing the same artificial light weight fine aggregate which is the same as that used in Example 4 and having an absolutely dry specific gravity of 1.649 and percentage of water absorption of 18%, a major portion of the aggregate was loaded in the filter cylinder and the remaining portion was loaded in hopper 24. After closing the lid 24 the pressure in the container 21 was reduced to −60 cm Hg. Then, a suitable quantity of water was sprinkled onto the aggregate contained in the filter cylinder 23 and the hopper 24 through sprinkling pipe 28 and thereafter the pressure in the container 21 was increased to the atmospheric pressure. Above described cycle of operation comprising the steps of evacuation. Sprinkling of water and recovering atmospheric pressure was repeated four times and then water was poured into the container until it covers the aggregate in the filter cylinder 23. However, there was no aggregate floating on the water. Thereafter, the aggregate remaining in the hopper 24 was transferred, little after little, into the filter cylinder 23 until the weight of the aggregate measured by the strain gauge has reached 115 Kg (corresponding to 200 Kg of the absolutely dry weight). Then the water in the container 21 was discharged by opening the valves, not shown, of discharge pipe 26 and **26*a* while at the same time the container was evacuated to −60 cm Hg through evacuation pipe 36**. After evacuation for 30 seconds the weight of the aggregate was measured and found to be 222 Kg. The water content of the aggregate was 29%. This fine aggregate was used to prepare mortar suitable for use in said prepack method together with cement, additional water of 8 Kg, and 1% of the fluidity improving additive at a ratio of cement:aggregate:water of 1:0:8:0.4. The value of Fo of this mortar was 2.3 g, showing expected fluidity necessary to pour the mortar over a distance of 4 m into a mold prepacked with an artificial light weight coarse aggregate having a grain size of 10 to 20 mm.

The same artificial light weight fine aggregate was weighed in water, and dehydrated naturally without evacuation. Such dehydrated aggregate had a weight of 288.6 Kg and a water content of 44.3%, 47.4 Kg of water was added to prepare mortar of the same formulation as above described. The value of Fo of the resulting mortar was 4.5 g which is considerably larger than 2.9 g showing poor pouring characteristic.

EXAMPLE 6

The weight of an artificial light weight coarse aggregate having an absolutely dry specific gravity of 1.561 and a particle size of less than 15 mm was measured by the method described in Example 3 and by using the apparatus shown in FIG. 9. The weight in water was 78.3 Kg. The weight of the aggregate after discharging water through discharge pipes and removal of residual surface water by compressed air ejected through perforation 32 was weighed to be 210 Kg showing that the interstice water was 1.8%.

As a control, an artificial light weight fine aggregate having an absolute dry specific weight of 1.649 and subjected to the same treatment as in Example 5 was weighed by using the apparatus shown in FIG. 9. The weight of this aggregate in water was 115 Kg, and the weight after draining water and evacuation to −60 cm Hg for 30 seconds was 222 Kg and its water content was 29%.

In order to prepare concrete having a W/C ratio of 54.4% and a slump of 15 cm by using the artificial light weight coarse and fine aggregate which were treated and weighed as above described, it was found that the fine aggregate should have an absolute dry weight of 554 $Kg/m^3$ for preparing 340 $Kg/m^3$ of the concrete whereas the coarse aggregate should have an absolute weight of 525 $Kg/m^3$, and that the quantity of water to be added for realizing said W/C ratio of 54.4% should be 185 Kg/m³. It was determined that the quantity of water to be added for preparing 360 l of concrete according to the formulation described above and by using respective aggregates which have been dehydrated in a manner as above described was 39.4 l. The resulting concrete had a slump of 14 cm which is close to the contemplated value of 15 cm.

On the other hand, the amount of the water to be added for preparing 360 l of concrete according to the same formulation by using respective aggregates which have been weighed in water but not subjected to dehydration treatment was calculated to be −1.1 l showing that such aggregates could not be used for preparing the contemplated concrete. The slump of such concrete was 18.5 cm.

The product formed with concrete having a slump of 13 cm had a compression strength of 350 Kg/cm² 28 days after removal from the mold, whereas the product formed with concrete having a slump of 18.5 cm had a compression strength of 256 Kg/cm² 28 days after removal from the mold.

EXAMPLE 7

Medium particle size sand having an absolutely dry specific gravity of 2.51 and caused to sufficiently absorve water was weighed in water and found to be 275.9 Kg. Thereafter, vibration was applied to the sand by the vibrator 6 and the sand was dehydrated under vacuum of −30 cm Hg applied through perforations 15 for 60 seconds . After these treatments the weight of the sand was 231.8 Kg and its water content was determined to be 15.9% based on the measured weights and the absolutely dry specific gravity.

To prepare concrete having a W/C ratio of 50% and a slump of 12 cm by using river gravel whose surface is dry and having a particle size of less than 25 mm the formulation should be: 316 Kg/m³ of cement, 158 Kg/m³ of water, 681 Kg/m³ (absolute dry weight) of sand, 1210 Kg/m³ of river gravel and 0.5%, based on the weight of cement, of the fluidity improving additive. Actually, however, 342 l of concrete was prepared by admixing 93 Kg of cement, 20.2 Kg of water, 255 Kg of sand and 356 Kg of river gravel. This concrete had a slump value of 13.5 cm showing that it had desired characteristics. A product made of this concrete had a compression strength of 210 Kg/cm² after one week and 355 Kg/cm² after 355 Kg/cm² showing that the product was excellent.

In contrast, the aggregate which has been weighed in water but not evacuated, and dehydrated naturally had a water content of 27.5%. The quantity of water necessary to be added to concrete utilizing this aggregate was calculated to be −3 Kg, which shows that this aggregate can not be used to prepare desired concrete.

EXAMPLE 8

The same medium particle size sand as in Example 7 was weighed by the apparatus shown in FIG. 9 and processed by similar steps as described in Examples 4 and 5 except that the vacuum at the time of pouring water and dehydration was changed to −30 mm Hg and the time of dehydration was changed to 90 seconds. The weight of the sand in water was 126 Kg, and that after dehydration was 230 Kg. The water content of the sand after dehydration was calculated by using said two values of the weight, the absolutely dry specific gravity and the water content and concrete was prepared by using 93 Kg of cement, 22 Kg of water, 230 Kg of said sand, 355 Kg of gravel and 460 g of the fluidity improving additive according to the formulation described in Example 7. The product prepared by this concrete had a compression strength of 218 Kg/cm² after one week and 360 Kg/cm² after 4 weeks showing that the product had contemplated characteristics.

In contrast, the same sand not treated according to this invention, but merely dehydrated naturally had a water content of 29% and the amount of water to be added was found to be −6 Kg, showing that such sand can not be used to prepare concrete.

What is claimed is:

1. A method of preparing aggregate to be utilized to prepare concrete or mortar, comprising the steps of:
   - loading aggregate in a container;
   - pouring water into said container to a level to completely immerse said aggregate therein;
   - weighing aggregate while it is being immersed in said water to determine the volume of the aggregate;
   - discharging the water from said container; and
   - removing water remaining in the interstice of said aggregate to adjust said aggregate to at least a capillary state.

2. The method according to claim 1 which further comprises the step of weighing the resulting aggregate to determine the quantity of water contained in said aggregate.

3. The method according to claim 1 wherein some of the air contained in the interstice and the structure of said aggregate is removed before the water is poured into the container.

4. The method according to claim 3 wherein said air removal is attained by reducing the pressure in the container.

5. The method according to claim 1 wherein air contained in the interstice and the structure of said aggregate is removed after the water is poured into the container by any one or combinations of stirring, evacuation, vibration and water flow in the container.

6. The method according to claim 1 wherein said aggregate comprises light weight aggregate having a specific gravity of less than 1 and wherein before weighing said aggregate in water, the aggregate is repeatedly subjected to water sprinkling, evacuation and pressure recovery to atmospheric pressure so as to cause water to permeate into the structure of the aggregate.

7. The method according to claim 1 wherein an activation agent is incorporated into said water.

8. The method according to claim 1 wherein the major portion of said aggregate is loaded in said container while the remaining portion is loaded in a hopper provided in said container, water is poured in said container, the weight of the major portion of the aggregate is measured while being immersed in water, the remaining portion of said aggregate is transferred from said hopper to said container to increase the quantity of said aggregate to a predetermined amount, the water in the interstice of the aggregate of said predetermined amount is removed, and the weight of the resulting aggregate is measured.

9. The method according to claim 1 wherein said water removal is attained by applying the evacuation on said container from the bottom thereof.

10. The method according to claim 9 wherein the pressure is applied on the upper portion of said container during said evacuation.

11. The method according to claim 1 wherein the water remaining in the interstice of said aggregate is removed by passing gas through said aggregate while preventing floating thereof.

12. The method according to claim 1 wherein the water remaining in the interstice of the aggregate is removed by applying centrifugal force, vibration or supersonic wave.

13. The method according to claim 2 which further comprises the steps of mixing the aggregate as prepared with the cement and thereafter mixing the resulting mixture with the water.

14. An apparatus for preparing aggregate to be utilized to prepare concrete or mortar comprising:

a container having an aggregate loading opening at the top thereof;

means for pouring water into said container;

means for weighing aggregate while it is being immersed in said water;

means for discharging water from said container; and means for removing water remaining in the interstice of said aggregate.

15. The apparatus according to claim 14 which further comprises means for removing air contained in the interstice and the structure of said aggregate.

16. The apparatus according to claim 14 wherein a filter cylinder is disposed in said container, said filter cylinder and said container defining a gap therebetween, and said filter cylinder is provided with perforations having a size which will not permit passage of said aggregate.

17. The apparatus according to claim 14 which further comprises means for causing said water to flow thereby removing air contained in said aggregate.

18. The apparatus according to claim 14 wherein said container is provided with a water overflow port at one side wall thereof.

19. The apparatus according to claim 14 which further comprises a vibrator connected to said container for enhancing removal of water from said aggregate.

20. The apparatus according to claim 14 which further comprises a closure member for closing said bottom opening of said container, and a conduit means for actuating said closure member, said conduit means being provided with perforations for ejecting gas to remove water from said aggregate.

21. The apparatus according to claim 14 wherein said container comprises means for airtightly sealing the same and means for reducing the pressure in said container.

22. The apparatus according to claim 14 which further comprises means for sprinkling water onto aggregate loaded in said container.

23. The apparatus according to claim 14 which further comprises a hopper mounted on the inner side wall of said container for receiving a portion of the aggregate loaded in said container, and means for transferring the aggregate in said hopper to said filter cylinder.

24. The apparatus according to claim 14 wherein said container comprises a first overflow opening formed at a level sufficient to completely cover the aggregate loaded in said container with water and a second overflow opening formed at a lower level than said first overflow opening so as to expose the upper surface of said aggregate when water in the container is discharged through said second overflow opening.

* * * * *